US010655900B2

(12) United States Patent
Tanaka et al.

(10) Patent No.: US 10,655,900 B2
(45) Date of Patent: May 19, 2020

(54) AIR-CONDITIONING APPARATUS

(71) Applicant: Mitsubishi Electric Corporation, Tokyo (JP)

(72) Inventors: Kosuke Tanaka, Tokyo (JP); Hiroaki Makino, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/354,664

(22) Filed: Mar. 15, 2019

(65) Prior Publication Data

US 2019/0212044 A1 Jul. 11, 2019

Related U.S. Application Data

(62) Division of application No. 15/120,790, filed as application No. PCT/JP2014/055982 on Mar. 7, 2014, now abandoned.

(51) Int. Cl.
*F25B 43/00* (2006.01)
*F25B 45/00* (2006.01)
(Continued)

(52) U.S. Cl.
CPC ..... *F25B 45/00* (2013.01); *F25B 13/00* (2013.01); *F24F 11/37* (2018.01); *F25B 43/006* (2013.01);
(Continued)

(58) Field of Classification Search
CPC ..... F25B 2600/15; F25B 2600/2523; F25B 13/00; F25B 43/006; F25B 2400/0415; F25B 45/00; F25B 2400/19; F24F 11/37
See application file for complete search history.

(56) References Cited

U.S. PATENT DOCUMENTS 5,157,933 A * 10/1992 Brendel ..... F25B 1/10 62/196.4
2004/0231352 A1* 11/2004 Matsuoka ..... F25B 45/00 62/292
(Continued)

FOREIGN PATENT DOCUMENTS

CN 102419035 A 4/2012
CN 103140728 A 6/2013
(Continued)

OTHER PUBLICATIONS

International Search Report of the International Searching Authority dated Jun. 3, 2014 for the corresponding international application No. PCT/JP2014/055982 (and English translation).
(Continued)

*Primary Examiner* — David J Teitelbaum
(74) *Attorney, Agent, or Firm* — Posz Law Group, PLC

(57) ABSTRACT

Provided is an air-conditioning apparatus configured so that a decrease in a refrigeration capacity can be suppressed without increasing the amount of refrigerant with which a refrigerant circuit is filled and that refrigerant can be suitably stored during a pump down operation. The air-conditioning apparatus includes a first on-off valve provided at a pipe between an expansion valve and a use side heat exchanger, a bypass branching from a pipe between the expansion valve and the first on-off valve and connected to a pipe at a suction-side of a compressor, and a refrigerant storage unit configured to store the refrigerant having passed through the bypass. In a pump down operation in which the compressor operates with the first on-off valve being in a closed state, the refrigerant having flowed out from the heat source side heat exchanger flows into the bypass, and then, is stored in the refrigerant storage unit.

2 Claims, 4 Drawing Sheets

(51) Int. Cl.
*F25B 13/00* (2006.01)
*F24F 11/37* (2018.01)

(52) U.S. Cl.
CPC ... *F25B 2400/0415* (2013.01); *F25B 2400/19* (2013.01); *F25B 2600/15* (2013.01); *F25B 2600/2523* (2013.01)

(56) References Cited

U.S. PATENT DOCUMENTS

| | | | | |
|---|---|---|---|---|
| 2006/0288724 | A1* | 12/2006 | Ambs | F25B 13/00 62/260 |
| 2012/0073311 | A1 | 3/2012 | Jeong et al. | |
| 2013/0061614 | A1 | 3/2013 | Jeong et al. | |
| 2013/0174590 | A1* | 7/2013 | Sjoholm | F25B 41/04 62/115 |
| 2013/0174595 | A1 | 7/2013 | Okuda et al. | |
| 2015/0052925 | A1 | 2/2015 | Hata et al. | |

FOREIGN PATENT DOCUMENTS

| | | | |
|---|---|---|---|
| EP | 1582827 | A1 | 10/2005 |
| EP | 2511630 | A1 | 10/2012 |
| EP | 2 623 894 | A1 | 8/2013 |
| JP | 05-248717 | A | 9/1993 |
| JP | 06-034222 | A | 2/1994 |
| JP | 2002-081767 | A | 3/2002 |
| JP | 2006-125717 | A | 5/2006 |
| JP | 2013-113498 | A | 6/2013 |
| JP | 2013-122364 | A | 6/2013 |
| JP | 5212537 | B1 | 6/2013 |
| JP | 2013-204922 | A | 10/2013 |
| KR | 10-0159238 | B1 | 1/1999 |
| WO | 2011/070954 | A1 | 6/2011 |

OTHER PUBLICATIONS

Office Action dated May 7, 2015 issued in corresponding JP patent application No. 2015-510529 (and English translation).
Australian Office Action dated Mar. 10, 2017 issued in corresponding AU application No. 2014385084.
Office Action dated Jun. 27, 2017 issued in corresponding KR patent application No. 10-2016-7026168 (and English translation).
Extended European Search Report dated Oct. 11, 2017 corresponding to EP patent application No. 14884659.5.
Office Action dated Feb. 24, 2018 issued in corresponding CN patent application No. 201480076910.6 (and English translation).
Office Action dated Sep. 25, 2018 issued in corresponding CN patent application No. 201480076910.6 (and English translation).

* cited by examiner

AIR-CONDITIONING APPARATUS

CROSS REFERENCE TO RELATED APPLICATIONS

The present application is a divisional application of U.S. application Ser. No. 15/120,790 filed on Aug. 23, 2016, which is a U.S. national stage application of International Patent Application No. PCT/JP2014/055982 filed on Mar. 7, 2014, the contents of which are incorporated herein by reference.

TECHNICAL FIELD

The present invention relates to an air-conditioning apparatus including a refrigerant circuit in which a compressor, a heat source side heat exchanger, an expansion valve, and a use side heat exchanger are connected by pipes, and refrigerant circulates.

BACKGROUND

A refrigeration apparatus described in Patent Literature 1 includes a heat source side unit, a use side unit, and a controller. The heat source side unit includes a compressor, a heat source side heat exchanger, an expansion valve, a large-diameter tube, a liquid-refrigerant side shutoff valve, and a gas refrigerant side shutoff valve. These components are connected by refrigerant pipes. The use side unit includes a use side heat exchanger. One end of the use side heat exchanger is connected to the liquid-refrigerant side shutoff valve via a liquid refrigerant communication pipe, and the other end of the use side heat exchanger is connected to the gas refrigerant side shutoff valve via a gas refrigerant communication pipe. The controller executes a pump down operation for collecting refrigerant to the heat source side unit. In this refrigeration apparatus, refrigerant is, in the pump down operation, stored in the large-diameter tube provided between the heat source side heat exchanger and the liquid-refrigerant side shutoff valve.

PATENT LITERATURE

Patent Literature 1: Japanese Patent No. 5212537

As in the technique described in Patent Literature 1, considering refrigerant storage in the pump down operation, when the large-diameter tube is disposed at an outlet of the heat source side heat exchanger (a condenser), the following problems are caused.

That is, since the large-diameter tube is disposed at the outlet of the heat source side heat exchanger serving as the condenser in a cooling operation, refrigerant is stored in the large-diameter tube not only during the pump down operation but also during the cooling operation. For this reason, there is a problem that a refrigeration capacity decreases due to a decrease in the amount of refrigerant circulating in the refrigerant circuit.

On the other hand, when the amount of filling refrigerant is increased considering the amount of refrigerant stored in the large-diameter tube, there is a problem that a manufacturing cost increases due to such a refrigerant amount increase. In addition, when the amount of refrigerant with which the refrigerant circuit is filled is increased, there is a problem that an influence on environment due to refrigerant leakage increases. In particular, in the case of applying slightly flammable refrigerant (R32, HFO1234yf, HFO1234ze, etc.) or flammable refrigerant (HC), the permissible amount of refrigerant with which the refrigerant circuit is filled is limited by standards of the International Electrotechnical Commission (IEC), and the amount of filling refrigerant cannot be increased. For these reasons, the above-described problems become more notable.

SUMMARY

The present invention has been made in view of the above-described problems, and is intended to provide an air-conditioning apparatus configured so that a decrease in a refrigeration capacity can be suppressed without increasing the amount of refrigerant with which a refrigerant circuit is filled and that refrigerant can be suitably stored during a pump down operation.

An air-conditioning apparatus according to one embodiment of the present invention includes a refrigerant circuit in which a compressor, a heat source side heat exchanger, an expansion valve, and a use side heat exchanger are connected by pipes that circulate refrigerant. Such an air-conditioning apparatus includes a first on-off valve provided at a pipe between the expansion valve and the use side heat exchanger, a bypass branching from a pipe between the expansion valve and the first on-off valve and connected to a pipe on a suction side of the compressor, a second expansion valve provided at the bypass, a refrigerant storage unit configured to store the refrigerant having passed through the bypass, and a controller configured to operate the compressor and to perform a pump down operation in which the refrigerant is stored in the refrigerant storage unit. The refrigerant storage unit includes an accumulator provided on the suction side of the compressor, the bypass is connected to a pipe between an inflow side of the accumulator and the use side heat exchanger, and the controller performing the pump down operation controls the first on-off valve to be in a closed state so that the refrigerant flowing into the bypass from the heat source side heat exchanger is stored in the refrigerant storage unit. In a pump down operation in which the refrigerant flowing into the bypass is expanded by the second expansion valve, and then, flows into the accumulator, the refrigerant storage unit stores the refrigerant flowing into the accumulator.

According to one embodiment of the present invention, a decrease in a refrigeration capacity can be suppressed without increasing the amount of refrigerant with which the refrigerant circuit is filled, and refrigerant can be suitably stored during the pump down operation.

DETAILED DESCRIPTION

Embodiment 1

Figure 1:
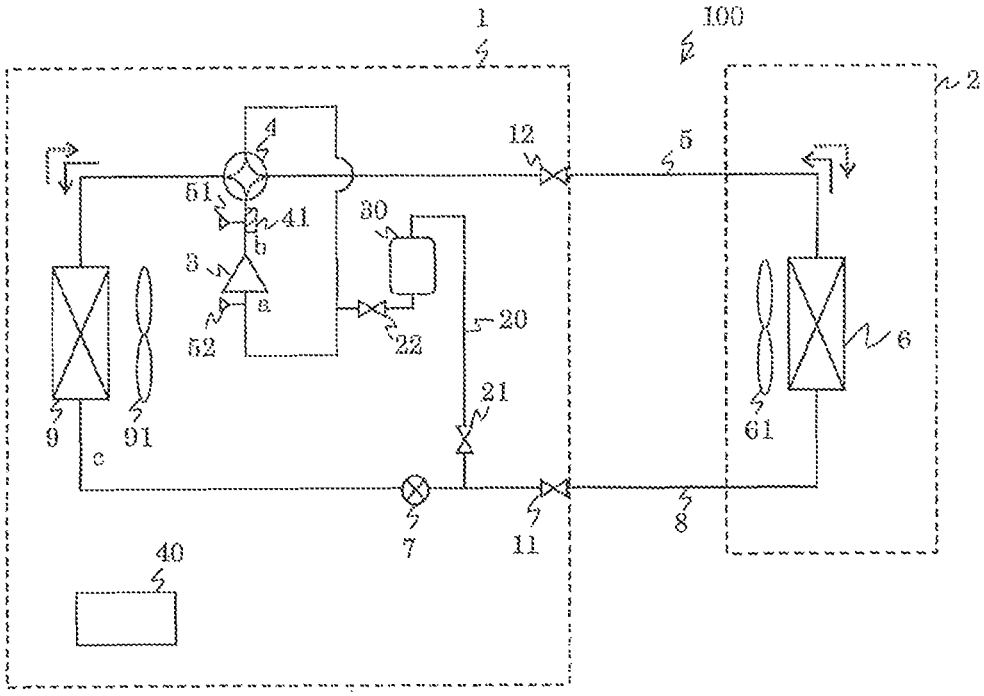
FIG. 1 is a refrigerant circuit diagram of an air-conditioning apparatus 100 according to Embodiment 1.

FIG. 1 is a refrigerant circuit diagram of an air-conditioning apparatus 100 according to Embodiment 1.

As illustrated in FIG. 1, the air-conditioning apparatus 100 includes an outdoor unit 1 and an indoor unit 2, and the outdoor unit 1 and the indoor unit 2 are connected by a liquid pipe 8 and a gas pipe 5.

The outdoor unit 1 includes a compressor 3, a four-way valve 4, a heat source side heat exchanger 9, an expansion valve 7, a heat source side fan 91 configured to send air to the heat source side heat exchanger 9, and a controller 40 configured to control operation of each section forming the air-conditioning apparatus 100.

The indoor unit 2 includes a use side heat exchanger 6 and a use side fan 61 configured to send air to the use side heat exchanger 6.

The compressor 3, the four-way valve 4, the heat source side heat exchanger 9, the expansion valve 7, and the use side heat exchanger 6 are, in the air-conditioning apparatus 100, successively connected by pipes to form a refrigerant circuit in which refrigerant circulates.

The outdoor unit 1 further includes a bypass 20 branching from the pipe between the expansion valve 7 and a first on-off valve 11 and connected to the pipe at a suction-side of the compressor 3. The bypass 20 is provided with a first bypass on-off valve 21, a second bypass on-off valve 22, and a container 30 configured to store refrigerant.

The compressor 3 is a type of compressor in which rotation speed is controlled by, for example, an inverter and the capacity is controlled.

The expansion valve 7 is, for example, an electronic expansion valve whose opening degree is variably controlled.

The heat source side heat exchanger 9 is configured to exchange heat with the external air sent by the heat source side fan 91.

The use side heat exchanger 6 is configured to exchange heat with the indoor air sent by the use side fan 61.

The first bypass on-off valve 21 is provided on a refrigerant inflow side (a side close to the pipe between the expansion valve 7 and the first on-off valve 11) of the bypass 20.

The second bypass on-off valve 22 is provided on a refrigerant outflow side (a side close to the pipe at a suction-side of the compressor 3) of the bypass 20.

The first bypass on-off valve 21 and the second bypass on-off valve 22 are on-off valves configured to open/close a refrigerant flow path of the bypass 20.

The container 30 is a container configured to store refrigerant.

Note that the container 30 corresponds to a "refrigerant storage unit" of the present invention.

The gas pipe 5 and the liquid pipe 8 are connection pipes connecting the outdoor unit 1 and the indoor unit 2. The first on-off valve 11 and a second on-off valve 12 are connected respectively to the liquid pipe 8 and the gas pipe 5. The liquid pipe 8 connects between the use side heat exchanger 6 of the indoor unit 2 and the first on-off valve 11 of the outdoor unit 1. The gas pipe 5 connects between the use side heat exchanger 6 of the indoor unit 2 and the second on-off valve 12 of the outdoor unit 1.

Note that the first on-off valve 11, the second on-off valve 12, the first bypass on-off valve 21, and the second bypass on-off valve 22 may be manual valves configured to be manually opened/closed, or solenoid valves whose opening/closing state is controlled by the controller 40.

The outdoor unit 1 further includes a discharge temperature sensor 41, a discharge pressure sensor 51, and a suction pressure sensor 52.

The discharge temperature sensor 41 is configured to detect the temperature of refrigerant discharged from the compressor 3.

The discharge pressure sensor 51 is configured to detect the pressure of refrigerant discharged from the compressor 3.

The suction pressure sensor 52 is configured to detect the pressure of refrigerant to be sucked into the compressor 3.

Note that the pressure of refrigerant circulating in the refrigerant circuit is the lowest on a suction side of the compressor 3, and is the highest on a discharge side of the compressor 3. Thus, in description below, the pressure on the suction side of the compressor 3 is referred to as a "low pressure," and the pressure on the discharge side of the compressor 3 is referred to as a "high pressure."

Slightly flammable refrigerant (R32, HFO1234yf, HFO1234ze, etc.) and flammable refrigerant (HC) are used as the refrigerant used for a refrigeration cycle (the refrigerant circuit) of the air-conditioning apparatus 100.

For example, tetrafluoropropene (HFO1234yf as 2,3,3,3-tetrafluoropropene, HFO1234ze as 1,3,3,3-tetrafluoro-1-propene, etc.) or difluoromethane (HFC32) are used as the material to be mixed for producing a refrigerant mixture. However, the present invention is not limited to these materials. For example, HC290 (propane) may be mixed. Any materials may be used as long as the material has such thermal performance as to be capable of being used as refrigerant for the refrigeration cycle (the refrigerant circuit), and any mixing ratio may be adopted.

Note that the refrigerant used in the present invention is not limited to the above-described refrigerant. For example, refrigerant such as R410A may be used.

The air-conditioning apparatus 100 configured as described above is able to perform a cooling or heating operation by switching the four-way valve 4. Moreover, the air-conditioning apparatus 100 is able to perform a pump down operation for collecting refrigerant in the indoor unit 2 to the outdoor unit 1.

Note that the air-conditioning apparatus 100 may be configured to perform at least the cooling operation and the pump down operation. Thus, the four-way valve 4 is not necessarily provided, and can be omitted.

Next, operation of the air-conditioning apparatus 100 in the refrigeration cycle will be described with reference to FIG. 1. In FIG. 1, a solid line indicates a flow in the cooling operation, and a dashed line indicates a flow in the heating operation.

(Cooling Operation)

First, the cooling operation in normal operation will be described.

In the cooling operation, the four-way valve 4 is switched to a cooling operation mode (the state indicated by the solid line). Moreover, the first on-off valve 11, the second on-off valve 12, and the second bypass on-off valve 22 are in an open state. The first bypass on-off valve 21 is in a closed state.

In such a state, when high-pressure high-temperature gas refrigerant is discharged from the compressor 3, the high-pressure high-temperature gas refrigerant flows into the heat source side heat exchanger 9 via the four-way valve 4. The gas refrigerant transfers heat by heat exchange with outdoor air, and then, flows out as high-pressure liquid refrigerant.

The high-pressure liquid refrigerant having flowed out from the heat source side heat exchanger 9 flows into the expansion valve 7, and then, turns into low-pressure two-phase refrigerant.

The low-pressure two-phase refrigerant having flowed out from the expansion valve 7 flows into the indoor unit 2 through the liquid pipe 8. Such refrigerant is evaporated by heat exchange with indoor air in the use side heat exchanger 6, and then, flows out as low-pressure gas refrigerant. The low-pressure gas refrigerant having flowed out from the use side heat exchanger 6 flows into the outdoor unit 1 through the gas pipe 5, and then, returns to the compressor 3 via the four-way valve 4.

Note that during the cooling operation, the first bypass on-off valve 21 is in the closed state, and therefore, no refrigerant flows into the bypass 20. Moreover, the second bypass on-off valve 22 is in the open state, and therefore, liquid sealing of the container 30 can be prevented.

(Heating Operation)

Next, the heating operation in the normal operation will be described.

In the heating operation, the four-way valve 4 is switched to a heating operation mode (the state indicated by the dashed line). Moreover, the first on-off valve 11, the second on-off valve 12, and the second bypass on-off valve 22 are in the open state. The first bypass on-off valve 21 is in the closed state.

In such a state, when high-pressure high-temperature gas refrigerant is discharged from the compressor 3, the high-pressure high-temperature gas refrigerant flows into the use side heat exchanger 6 of the indoor unit 2 via the four-way valve 4 and the gas pipe 5. Such refrigerant transfers heats by heat exchange with indoor air, and then, flows out as high-pressure liquid refrigerant. The high-pressure liquid refrigerant having flowed out from the use side heat exchanger 6 flows into the expansion valve 7 through the liquid pipe 8, and then, turns into low-pressure two-phase refrigerant.

The low-pressure two-phase refrigerant having flowed out from the expansion valve 7 flows into the heat source side heat exchanger 9. Such refrigerant is evaporated by heat exchange with outdoor air, and then, flows out as low-pressure gas refrigerant. The low-pressure gas refrigerant having flowed out from the heat source side heat exchanger 9 returns to the compressor 3 via the four-way valve 4.

Note that during the heating operation, the first bypass on-off valve 21 is in the closed state, and therefore, no refrigerant flows into the bypass 20. Moreover, the second bypass on-off valve 22 is in the open state, and therefore, liquid sealing of the container 30 can be prevented.

(Pump Down Operation)

Next, the pump down operation will be described.

Figure 2:
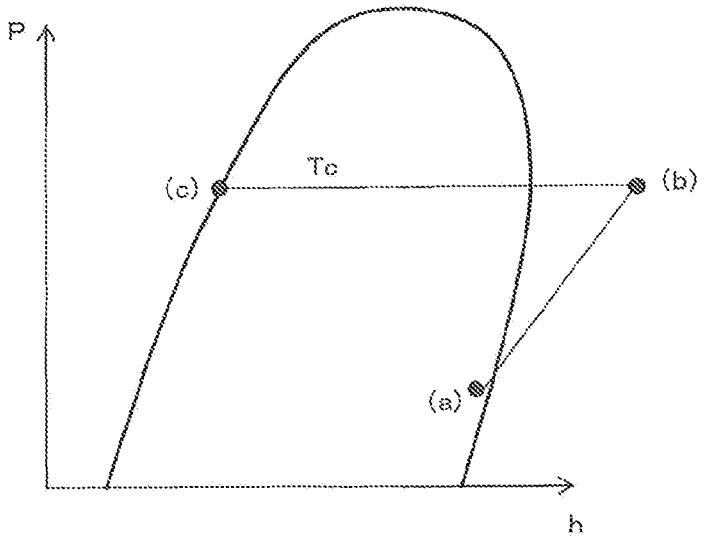
FIG. 2 is a p-h graph during a pump down operation of the air-conditioning apparatus 100 according to Embodiment 1.

FIG. 2 is a p-h graph during the pump down operation of the air-conditioning apparatus 100 according to Embodiment 1. In FIG. 2, the horizontal axis represents a specific enthalpy of refrigerant, and the vertical axis represents a pressure. Moreover, points a to c in FIG. 5 each indicate a refrigerant state at respective positions illustrated in FIG. 1.

In the pump down operation, the four-way valve 4 is switched to the cooling operation mode (the state indicated by the solid line). Moreover, the second on-off valve 12 and the first bypass on-off valve 21 are in the open state. The first on-off valve 11 and the second bypass on-off valve 22 are in the closed state. Further, the controller 40 fully opens the expansion valve 7. In addition, the controller 40 makes the heat source side fan 91 and the use side fan 61 operate.

In such a state, when the compressor 3 is started, low-pressure gas refrigerant (the state a) is compressed in the compressor 3, and then, is discharged as high-pressure high-temperature gas refrigerant (the state b). The high-pressure high-temperature gas refrigerant having been discharged from the compressor 3 flows into the heat source side heat exchanger 9 via the four-way valve 4. Such refrigerant transfers heat by heat exchange with outdoor air, and then, flows out as high-pressure liquid refrigerant (the state c). The high-pressure liquid refrigerant having flowed out from the heat source side heat exchanger 9 flows into the bypass 20 through the expansion valve 7.

The high-pressure liquid refrigerant (the state c) having flowed into the bypass 20 flows into the container 30 through the first bypass on-off valve 21. Since the second bypass on-off valve 22 is in the closed state, the high-pressure liquid refrigerant (the state c) having flowed into the bypass 20 is stored in the container 30.

Refrigerant in the use side heat exchanger 6, the liquid pipe 8, and the gas pipe 5 is sucked by operation of the compressor 3. After having been discharged from the compressor 3, the refrigerant is stored in the container 30 by the above-described operation.

By such a pump down operation, refrigerant of the indoor unit 2 is collected to the outdoor unit 1. After the pump down operation, the second on-off valve 12 is closed, and the indoor unit 2 is removed, for example.

In Embodiment 1 as described above, in the pump down operation, the refrigerant having flowed out from the heat source side heat exchanger 9 flows into the bypass 20, and then, is stored in the container 30.

Thus, in the pump down operation, refrigerant can be suitably collected to the outdoor unit 1. Moreover, it is not necessary to provide a storage container, such as a large-diameter tube, on an outlet side of the heat source side heat exchanger 9 (a condenser), and a decrease in a refrigeration capacity can be suppressed without increasing the amount of refrigerant with which the refrigerant circuit is filled.

Further, since the amount of refrigerant with which the refrigerant circuit is filled can be reduced, an increase in a manufacturing cost can be suppressed, and an influence on environment due to refrigerant leakage can be reduced.

(Modification)

Note that the case in which the bypass 20 branches from the pipe between the expansion valve 7 and the first on-off valve 11 and is connected to the pipe at a suction-side of the compressor 3 has been described above. However, the pipe between the heat source side heat exchanger 9 and the expansion valve 7 may branch off. In such a configuration, similar advantageous effects can be obtained by the operation similar to that described above.

Embodiment 2

Differences from Embodiment 1 will be mainly described in Embodiment 2. The same reference numerals as those of Embodiment 1 are used to represent identical elements, and description thereof will not be repeated.

Figure 3:
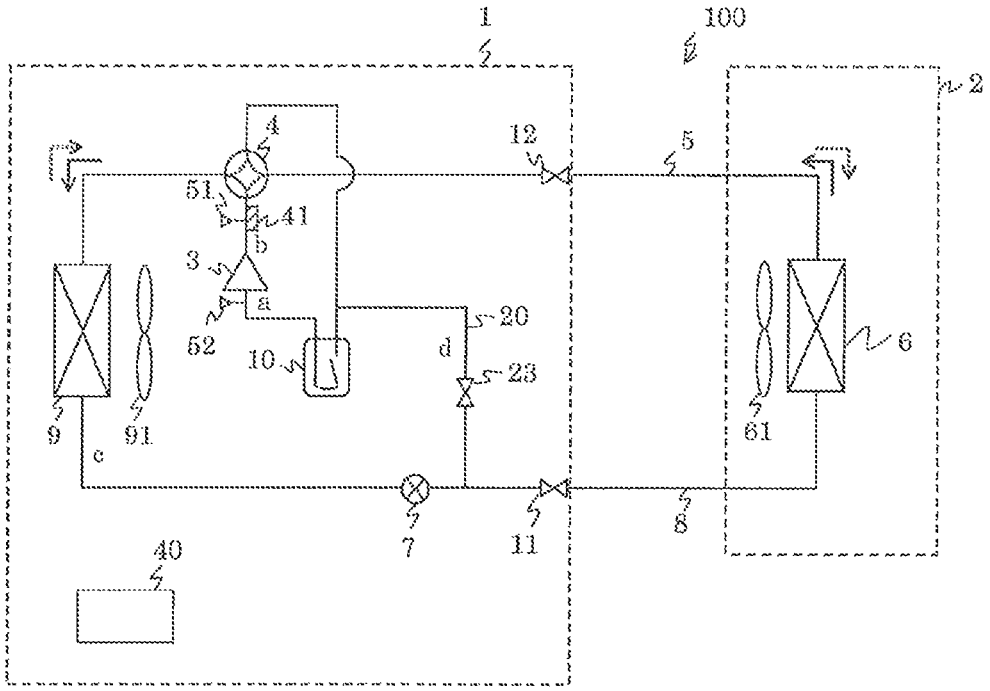
FIG. 3 is a refrigerant circuit diagram of an air-conditioning apparatus 100 according to Embodiment 2.

FIG. 3 is a refrigerant circuit diagram of an air-conditioning apparatus 100 according to Embodiment 2.

As illustrated in FIG. 3, the air-conditioning apparatus 100 of Embodiment 2 is configured such that an accumulator 10 configured to store extra refrigerant is provided on a suction side of a compressor 3. A bypass 20 is connected to a pipe at an inflow side of the accumulator 10.

Moreover, the bypass 20 is provided with a third bypass on-off valve 23. Note that in Embodiment 2, a first bypass on-off valve 21, a second bypass on-off valve 22, and a container 30 are not provided.

The third bypass on-off valve 23 has the function of opening/closing a flow path of the bypass 20 and expanding (depressurizing) passing refrigerant. For example, the pipe diameter of the bypass 20 on a downstream side (the side close to the accumulator 10) of the third bypass on-off valve 23 is smaller than that on an upstream side such that the refrigerant passing through the third bypass on-off valve 23 is expanded. Note that a configuration of the third bypass on-off valve 23 is not limited to such a configuration. For example, an electronic expansion valve whose opening degree is variably controlled may be used as the third bypass on-off valve 23. Alternatively, a two-way valve and a capillary tube may be connected in series. That is, any configurations can be used as long as a flow of refrigerant in the bypass 20 can be opened/closed such that passing refrigerant is expanded (depressurized).

Note that the third bypass on-off valve 23 corresponds to a "second expansion valve" of the present invention.

Next, differences from Embodiment 1 in operation of the air-conditioning apparatus 100 of Embodiment 2 will be mainly described.

(Cooling Operation, Heating Operation)

In the cooling operation and the heating operation, the third bypass on-off valve 23 is in a closed state.

In such a state, the cooling operation and the heating operation are performed by the operation similar to that of Embodiment 1. Since the third bypass on-off valve 23 is in the closed state, no refrigerant flows into the bypass 20.

Note that in the case in which wet gas refrigerant (two-phase refrigerant) flows out from an evaporator, the accumulator 10 separates such refrigerant into gas refrigerant and liquid refrigerant, and then, the gas refrigerant is sucked into the compressor 3.

(Pump Down Operation)

Next, a pump down operation will be described.

Figure 4:
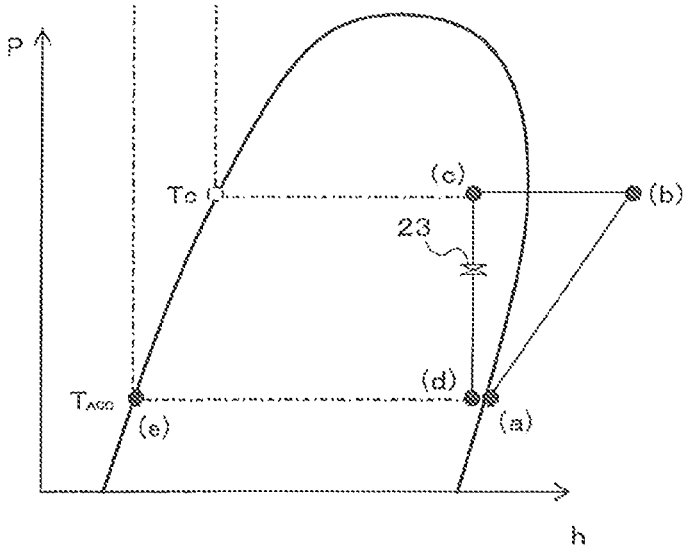
FIG. 4 is a p-h graph during a pump down operation of the air-conditioning apparatus 100 according to Embodiment 2.

FIG. 4 is a p-h graph during the pump down operation of the air-conditioning apparatus 100 according to Embodiment 2. In FIG. 4, the horizontal axis represents a specific enthalpy of refrigerant, and the vertical axis represents a pressure. Moreover, points a to e in FIG. 4 each indicate a refrigerant state at respective positions illustrated in FIG. 3.

In the pump down operation, a four-way valve 4 is switched to a cooling operation mode (the state indicated by a solid line). Moreover, a second on-off valve 12 and the third bypass on-off valve 23 are in an open state. A first on-off valve 11 is in the closed state. Further, a controller 40 fully opens an expansion valve 7. In addition, the controller 40 makes a heat source side fan 91 and a use side fan 61 operate.

Note that in Embodiment 2, the heat source side fan 91 may be stopped, or the amount of air sent by the heat source side fan 91 may be decreased so that heat exchange amount by a heat source side heat exchanger 9 is decreased.

In such a state, when the compressor 3 is started, low-pressure gas refrigerant (the state a) is compressed in the compressor 3, and then, is discharged as high-pressure high-temperature gas refrigerant (the state b). The high-pressure high-temperature gas refrigerant having been discharged from the compressor 3 flows into the heat source side heat exchanger 9 via the four-way valve 4. Such refrigerant transfers heat by heat exchange with outdoor air, and then, flows out as high-pressure two-phase refrigerant (the state c). The high-pressure two-phase refrigerant having flowed out from the heat source side heat exchanger 9 flows into the bypass 20 through the expansion valve 7.

The high-pressure liquid refrigerant (the state c) having flowed into the bypass 20 is expanded (depressurized) when passing through the third bypass on-off valve 23, and turns into low-pressure two-phase refrigerant (the state d). The low-pressure two-phase refrigerant flows into the accumulator 10 from the bypass 20, and then, is separated into gas refrigerant (the state a) and liquid refrigerant (the state e). The gas refrigerant in the accumulator 10 is sucked into the compressor 3. On the other hand, the liquid refrigerant is stored in the accumulator 10.

Refrigerant in a use side heat exchanger 6, a liquid pipe 8, and a gas pipe 5 is sucked by operation of the compressor 3, and then, flows into the accumulator 10. Such refrigerant is separated into gas refrigerant and liquid refrigerant, and the liquid refrigerant is stored in the accumulator 10.

By such a pump down operation, refrigerant of an indoor unit 2 is collected to an outdoor unit 1. After the pump down operation, the second on-off valve 12 is closed, and the indoor unit 2 is removed, for example.

In Embodiment 2 as described above, the third bypass on-off valve 23 is provided at the bypass 20 such that the refrigerant having flowed into the bypass 20 is expanded (depressurized), and such refrigerant is stored in the accumulator 10.

Thus, in addition to the advantageous effects of Embodiment 1 described above, there are the following advantageous effects. That is, the refrigerant stored in the accumulator 10 is expanded (depressurized) low-pressure liquid refrigerant (see $T_{ACC}$ in FIG. 4). As compared to the case in which high-pressure refrigerant (see $T_C$ in FIG. 4) is stored, a refrigerant temperature is lower, and a refrigerant density may be increased. Thus, the capacity of a refrigerant storage unit (the accumulator 10) configured to store refrigerant in the pump down operation can be decreased.

(Modification)

Note that the case in which the bypass 20 branches from the pipe between the expansion valve 7 and a first on-off valve 11 and is connected to the pipe at a suction-side of the compressor 3 has been described above. However, the pipe between the heat source side heat exchanger 9 and the expansion valve 7 may branch off. In such a configuration, similar advantageous effects can be obtained by the operation similar to that described above.

Embodiment 3

Differences from Embodiment 2 will be mainly described in Embodiment 3. The same reference numerals as those of Embodiment 2 are used to represent identical elements, and description thereof will not be repeated.

Figure 5:
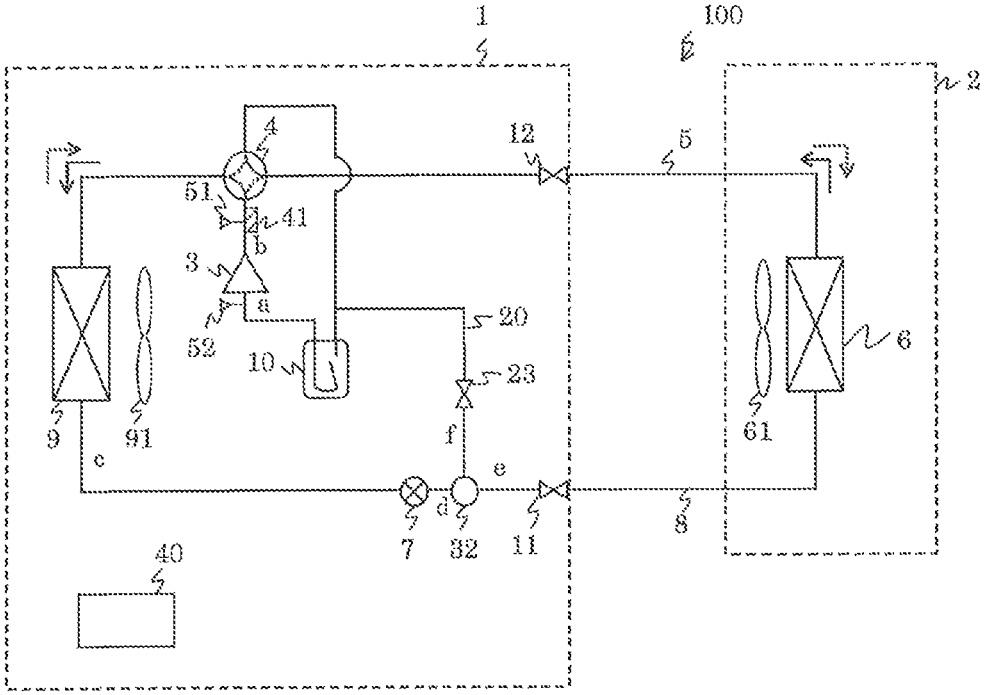
FIG. 5 is a refrigerant circuit diagram of an air-conditioning apparatus 100 according to Embodiment 3.

FIG. 5 is a refrigerant circuit diagram of an air-conditioning apparatus 100 according to Embodiment 3.

In addition to the configuration of Embodiment 2, the air-conditioning apparatus 100 according to Embodiment 3 further includes a gas-liquid separator 32 as illustrated in FIG. 5.

The gas-liquid separator 32 is provided at a pipe between an expansion valve 7 and a first on-off valve 11. The gas-liquid separator 32 is configured to separate refrigerant flowing therein into gas refrigerant and liquid refrigerant.

A bypass 20 connects a gas-side connection port of the gas-liquid separator 32 and a pipe at a suction-side of a compressor 3.

Next, differences from Embodiment 2 in operation of the air-conditioning apparatus 100 of Embodiment 3 will be mainly described.

(Cooling Operation)

Figure 6:
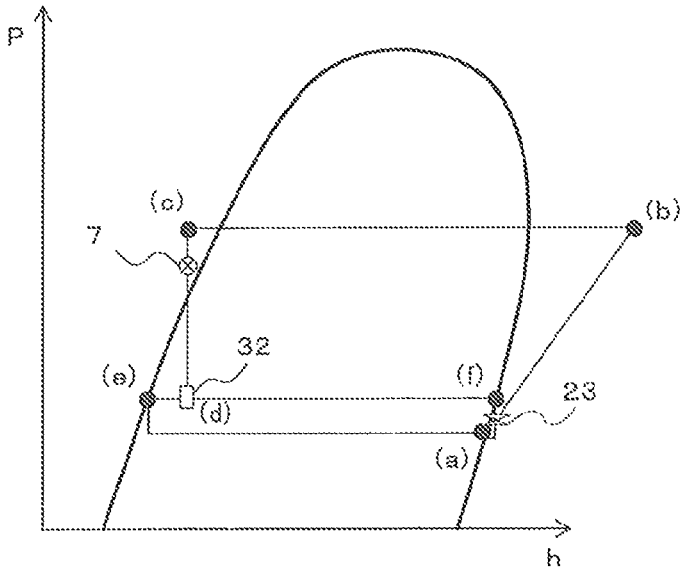
FIG. 6 is a p-h graph during a cooling operation of the air-conditioning apparatus 100 according to Embodiment 3.

FIG. 6 is a p-h graph during a cooling operation of the air-conditioning apparatus 100 according to Embodiment 3. In FIG. 6, the horizontal axis represents a specific enthalpy of refrigerant, and the vertical axis represents a pressure. Moreover, points a to f in FIG. 6 each indicate a refrigerant state at respective positions illustrated in FIG. 5.

For the sake of illustration, illustration is made such that there is a pressure difference between the state e and the state a in FIG. 6. In fact, such a pressure difference is merely a pressure decrease due to a pressure loss in a refrigerant flow path.

In the cooling operation, a four-way valve 4 is switched to a cooling operation mode (the state indicated by a solid line). Moreover, the first on-off valve 11, a second on-off valve 12, and a third bypass on-off valve 23 are opened.

In such a state, when the compressor 3 is started, low-pressure gas refrigerant (the state a) is compressed in the compressor 3, and then, is discharged as high-pressure high-temperature gas refrigerant (the state b). The high-pressure high-temperature gas refrigerant having been discharged from the compressor 3 flows into a heat source side heat exchanger 9 via the four-way valve 4. Such refrigerant transfers heat by heat exchange with outdoor air, and then, flows out as high-pressure liquid refrigerant (the state c). The high-pressure liquid refrigerant having flowed out from the heat source side heat exchanger 9 flows into the expansion valve 7, and turns into low-pressure two-phase refrigerant (the state d).

The low-pressure two-phase refrigerant having flowed out from the expansion valve 7 flows into the gas-liquid separator 32, and then, is separated into gas refrigerant (the state f) and liquid refrigerant (the state e). The gas refrigerant having flowed into the bypass 20 from the gas-liquid separator 32 flows into an accumulator 10 through the third bypass on-off valve 23.

Meanwhile, the liquid refrigerant (the state e) separated by the gas-liquid separator 32 flows into an indoor unit 2 through a liquid pipe 8. Then, such refrigerant is evaporated by heat exchange with indoor air in a use side heat exchanger 6, and then, flows out as low-pressure gas refrigerant. The low-pressure gas refrigerant having flowed out from the use side heat exchanger 6 flows into an outdoor unit 1 through a gas pipe 5, and then, returns to the compressor 3 via the four-way valve 4 and the accumulator 10.

(Heating Operation)

In a heating operation, the third bypass on-off valve 23 is in a closed state.

In such a state, the heating operation is performed by the operation similar to that of Embodiment 2. Since the third bypass on-off valve 23 is in the closed state, no refrigerant flows into the bypass 20.

(Pump Down Operation)

In a pump down operation, the third bypass on-off valve 23 is in an open state.

In this state, the pump down operation is performed by the operation similar to that of Embodiment 2 described above.

As described above, in Embodiment 3, the gas refrigerant separated in the gas-liquid separator 32 flows into the bypass 20 in the cooling operation.

Thus, in addition to the advantageous effects of Embodiments 1 and 2, there are the following advantageous effects. That is, in the cooling operation, the gas refrigerant separated in the gas-liquid separator 32 flows into the bypass 20. Thus, the quality of the refrigerant flowing into the use side heat exchanger 6 serving as an evaporator decreases, and a pressure loss of refrigerant can be reduced. Moreover, the gas refrigerant less contributing to heat exchange is bypassed, and therefore, a refrigeration capacity can be improved. Thus, energy saving can be improved in the cooling operation.

(Modification)

Note that the configuration including the gas-liquid separator 32 in addition to the configuration of Embodiment 2 has been described above. However, the configuration may be employed, in which the gas-liquid separator 32 is provided in addition to the configuration of Embodiment 1. Even in such a configuration, a first bypass on-off valve 21 and a second bypass on-off valve 22 are, in the cooling operation, opened such that the low-pressure gas refrigerant separated by the gas-liquid separator 32 may pass through a container 30 and join the suction side of the compressor 3. In this configuration, similar advantageous effects can be also obtained.

Embodiment 4

Differences from Embodiment 2 will be mainly described in Embodiment 4. The same reference numerals as those of Embodiment 2 are used to represent identical elements, and description thereof will not be repeated.

Figure 7:
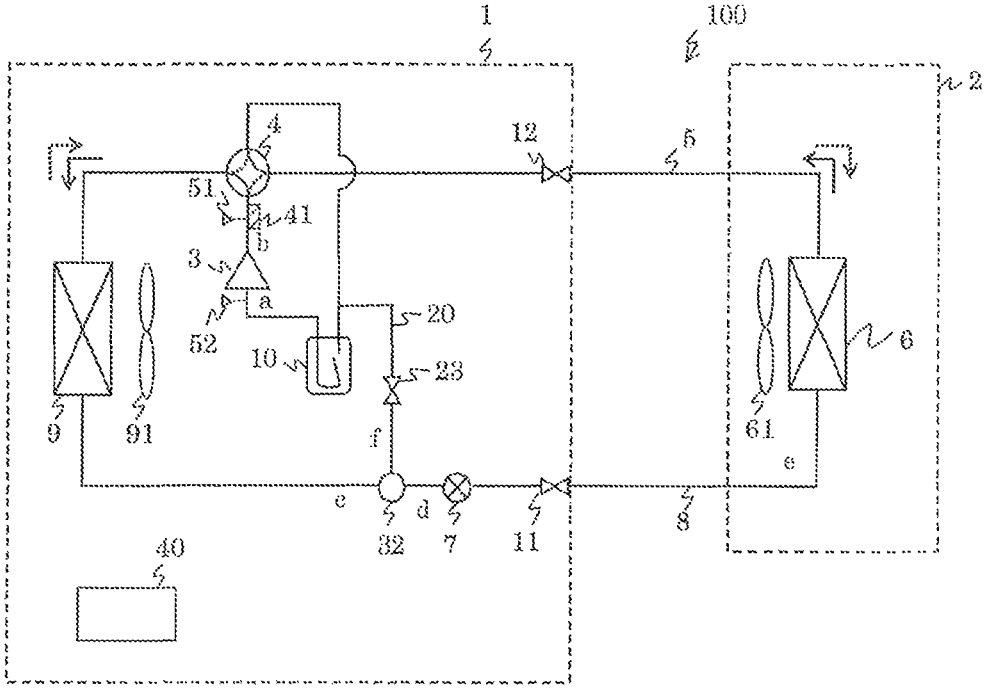
FIG. 7 is a refrigerant circuit diagram of an air-conditioning apparatus 100 according to Embodiment 4.

FIG. 7 is a refrigerant circuit diagram of an air-conditioning apparatus 100 according to Embodiment 4.

In addition to the configuration of Embodiment 2 described above, the air-conditioning apparatus 100 according to Embodiment 4 further includes a gas-liquid separator 32 as illustrated in FIG. 7.

The gas-liquid separator 32 is provided at a pipe between a heat source side heat exchanger 9 and an expansion valve 7. The gas-liquid separator 32 is configured to separate refrigerant flowing therein into gas refrigerant and liquid refrigerant.

A bypass 20 connects a connection port for gas of the gas-liquid separator 32 and a pipe at a suction-side of a compressor 3.

Next, differences from Embodiment 2 in operation of the air-conditioning apparatus 100 of Embodiment 3 will be mainly described.

(Cooling Operation)

In a cooling operation, a third bypass on-off valve 23 is in a closed state.

In such a state, the cooling operation is performed by the operation similar to that of Embodiment 2. Since the third bypass on-off valve 23 is in the closed state, no refrigerant flows into the bypass 20.

(Heating Operation)

Figure 8:
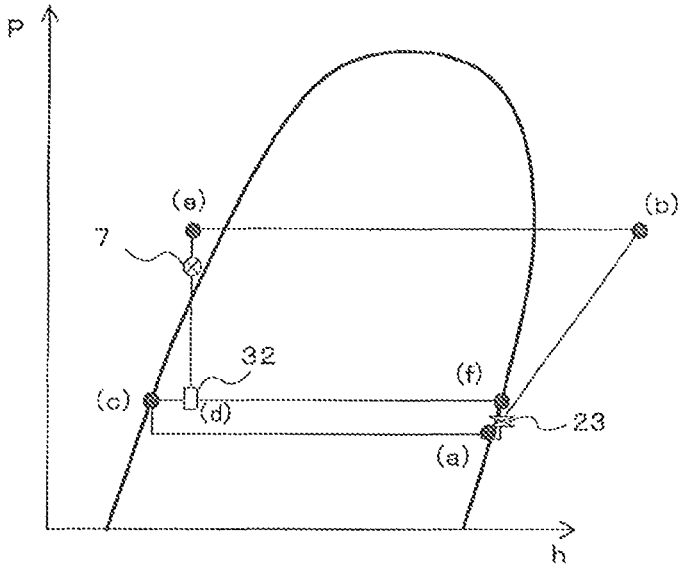
FIG. 8 is a p-h graph during a heating operation of the air-conditioning apparatus 100 according to Embodiment 4.

FIG. 8 is a p-h graph during a heating operation of the air-conditioning apparatus 100 according to Embodiment 4. In FIG. 8, the horizontal axis represents a specific enthalpy of refrigerant, and the vertical axis represents a pressure. Moreover, points a to f in FIG. 8 each indicate a refrigerant state at respective positions illustrated in FIG. 7.

For the sake of illustration, illustration is made such that there is a pressure difference between the state c and the state a in FIG. 8. In fact, such a pressure difference is merely a pressure decrease due to a pressure loss in a refrigerant flow path.

In the heating operation, a four-way valve 4 is switched to a heating operation mode (the state indicated by a dashed line). Moreover, a first on-off valve 11, a second on-off valve 12, and the third bypass on-off valve 23 are opened.

In such a state, when the compressor 3 is started, low-pressure gas refrigerant (the state a) is compressed in the compressor 3, and then, is discharged as high-pressure high-temperature gas refrigerant (the state b). The high-pressure high-temperature gas refrigerant having been discharged from the compressor 3 flows into a use side heat exchanger 6 of an indoor unit 2 via the four-way valve 4 and a gas pipe 5. Such refrigerant transfers heat by heat exchange with indoor air, and then, flows out as high-pressure liquid refrigerant (the state e). The high-pressure liquid refrigerant having flowed out from the use side heat exchanger 6 flows into the expansion valve 7 through a liquid pipe 8, and turns into low-pressure two-phase refrigerant (the state d).

The low-pressure two-phase refrigerant having flowed out from the expansion valve 7 flows into the gas-liquid separator 32, and then, is separated into gas refrigerant (the state f) and liquid refrigerant (the state c). The gas refrigerant having flowed into the bypass 20 from the gas-liquid separator 32 flows into an accumulator 10 through the third bypass on-off valve 23.

Meanwhile, the liquid refrigerant (the state c) separated by the gas-liquid separator 32 flows into the heat source side heat exchanger 9. Then, such refrigerant is evaporated by heat exchange with outdoor air, and then, flows out as low-pressure gas refrigerant (the state f). The low-pressure gas refrigerant having flowed out from the heat source side heat exchanger 9 returns to the compressor 3 via the four-way valve 4.

(Pump Down Operation)

In a pump down operation, the third bypass on-off valve 23 is in an open state.

In this state, the pump down operation is performed by the operation similar to that of Embodiment 2 described above.

As described above, in Embodiment 4, the gas refrigerant separated in the gas-liquid separator 32 flows into the bypass 20 in the heating operation.

Thus, in addition to the advantageous effects of Embodiments 1 and 2, there are the following advantageous effects. That is, in the heating operation, the gas refrigerant separated in the gas-liquid separator 32 flows into the bypass 20. Thus, the quality of the refrigerant flowing into the heat source side heat exchanger 9 serving as an evaporator decreases, and a pressure loss of refrigerant can be reduced. Moreover, the gas refrigerant less contributing to heat exchange is bypassed, and therefore, a refrigeration capacity can be improved. Thus, energy saving can be improved in the heating operation.

(Modification)

Note that the configuration including the gas-liquid separator 32 in addition to the configuration of Embodiment 2 has been described above. However, the configuration may be employed, in which the gas-liquid separator 32 is provided in addition to the configuration of Embodiment 1. Even in such a configuration, a first bypass on-off valve 21 and a second bypass on-off valve 22 are, in the heating operation, opened such that the low-pressure gas refrigerant separated by the gas-liquid separator 32 may pass through a container 30 and join the suction side of the compressor 3. In this configuration, similar advantageous effects can be also obtained.

The invention claimed is:

1. An air-conditioning apparatus comprising:

a refrigerant circuit in which a compressor, a heat source side heat exchanger, an expansion valve, and a use side heat exchanger are connected by pipes that circulate refrigerant;

a first on-off valve provided at a pipe between the expansion valve and the use side heat exchanger;

a bypass branching from a pipe between the expansion valve and the first on-off valve and connected to a pipe on a suction side of the compressor;

a second expansion valve provided at the bypass;

a refrigerant storage unit configured to store the refrigerant passed through the bypass; and a controller configured to operate the compressor and to perform a pump down operation in which the refrigerant is stored in the refrigerant storage unit, wherein the refrigerant storage unit comprises an accumulator provided on the suction side of the compressor, the bypass is connected to a pipe between an inflow side of the accumulator and the use side heat exchanger, the controller performing the pump down operation controls the first on-off valve to be in a closed state so that the refrigerant flowing into the bypass from the heat source side heat exchanger is stored in the refrigerant storage unit, and in the pump down operation, the refrigerant flowing into the bypass is expanded by the second expansion valve, and then, flows into the accumulator, and the refrigerant flowing into the accumulator is stored.

2. The air-conditioning apparatus of claim 1, further comprising a gas-liquid separator provided at the pipe between the expansion valve and the first on-off valve, wherein the bypass connects a gas side of the gas-liquid separator and the pipe on the suction side of the compressor, and in a cooling operation in which the heat source side heat exchanger serves as a condenser and the use side heat exchanger serves as an evaporator, a gaseous refrigerant separated by the gas-liquid separator flows into the bypass.

* * * * *